US008988178B2

(12) United States Patent
Deville et al.

(10) Patent No.: US 8,988,178 B2
(45) Date of Patent: Mar. 24, 2015

(54) DOWNHOLE INDUCTIVE COUPLER ASSEMBLIES

(75) Inventors: Benoit Deville, Paris (FR); Yann Dufour, Châtillon (FR); Bernard G Juchereau, Voisins-le-Bretonneux (FR); Christian Chouzenoux, St. Cloud (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/700,127

(22) PCT Filed: Jul. 1, 2011

(86) PCT No.: PCT/EP2011/003437

§ 371 (c)(1),
(2), (4) Date: Jan. 30, 2013

(87) PCT Pub. No.: WO2012/004000

PCT Pub. Date: Jan. 12, 2012

(65) Prior Publication Data

US 2013/0120093 A1 May 16, 2013

Related U.S. Application Data

(60) Provisional application No. 61/361,479, filed on Jul. 5, 2010.

(51) Int. Cl.

| | |
|---|---|
| ***H01F 21/04*** | (2006.01) |
| ***H01F 21/02*** | (2006.01) |
| ***H01F 27/28*** | (2006.01) |

(Continued)

(52) U.S. Cl.

CPC ..... *E21B 17/023* (2013.01); *E21B 17/028* (2013.01); *E21B 47/011* (2013.01); *E21B 47/122* (2013.01); *H01F 38/14* (2013.01)

USPC ..... 336/115; 336/5; 336/15; 336/126; 336/180; 336/212

(58) Field of Classification Search

USPC ..... 336/115, 5, 15, 132, 145, 146, 180, 212

See application file for complete search history.

(56) References Cited

U.S. PATENT DOCUMENTS 3,550,682 A 12/1970 Fowler
4,901,069 A * 2/1990 Veneruso ..... 340/854.8

(Continued)

FOREIGN PATENT DOCUMENTS

WO 99/31351 6/1999

OTHER PUBLICATIONS

International Search Report for the equivalent PCT patent application No. PCT/EP2011/003437 issued on Dec. 12, 2012.

*Primary Examiner* — Elvin G Enad
*Assistant Examiner* — Kazi Hossain
(74) *Attorney, Agent, or Firm* — Cameron R. Sneddon

(57) ABSTRACT

An inductive coupler assembly for use in a downhole environment and related methods are described. An example indicative coupler assembly includes a first inductive coupler having first and second magnetically coupled coils and a second inductive coupler having third and fourth magnetically coupled coils. The first and third coils are coupled to a first pair of signal lines and the second and fourth coils are coupled to a second pair of signal lines. The first inductive coupler is to magnetically convey a differential communications signal between the first and second pairs of signal lines, and the second inductive coupler is to magnetically convey a common mode power signal between the first and second pairs of signal lines.

16 Claims, 15 Drawing Sheets

(51) Int. Cl.

| | |
|---|---|
| ***H01F 27/24*** | (2006.01) |
| ***E21B 17/02*** | (2006.01) |
| ***E21B 47/01*** | (2012.01) |
| ***E21B 47/12*** | (2012.01) |
| ***H01F 38/14*** | (2006.01) |

(56) References Cited

U.S. PATENT DOCUMENTS

| | | | | |
|---|---|---|---|---|
| 5,052,941 | A | 10/1991 | Hernandez-Marti et al. | |
| 5,455,573 | A | 10/1995 | Delatorre | |
| 5,457,988 | A | 10/1995 | Delatorre | |
| 5,594,402 | A * | 1/1997 | Krichtafovitch et al. | 336/65 |
| 6,459,383 | B1 | 10/2002 | Delatorre | |
| 7,735,555 | B2 | 6/2010 | Patel et al. | |
| 7,902,955 | B2 | 3/2011 | Veneruso et al. | |
| 2005/0190584 | A1 * | 9/2005 | Hernandez-Marti et al. | 363/34 |
| 2010/0200291 | A1 | 8/2010 | Patel et al. | |
| 2010/0236774 | A1 | 9/2010 | Patel et al. | |
| 2011/0187485 | A1 * | 8/2011 | Toyoda et al. | 336/192 |
| 2012/0194313 | A1 * | 8/2012 | Wohlforth | 336/170 |

* cited by examiner

DOWNHOLE INDUCTIVE COUPLER ASSEMBLIES

RELATED APPLICATION

This patent claims the benefit of U.S. Provisional Application Ser. No. 61/361,479, filed Jul. 5, 2010, which is hereby incorporated herein in its entirety.

FIELD OF THE DISCLOSURE

This disclosure relates generally to oil and gas production and, more particularly, to downhole inductive coupler assemblies.

BACKGROUND OF THE DISCLOSURE

A completion system is installed in a well to produce hydrocarbon fluids, commonly referred to as oil and gas, from reservoirs adjacent the well or to inject fluids into the well. In many cases, the completion system includes electrical devices that have to be powered and which communicate with an earth surface or downhole controller. Traditionally, electrical cables are run to downhole locations to enable such electrical communication and power transfers.

DETAILED DESCRIPTION

Figure 1:
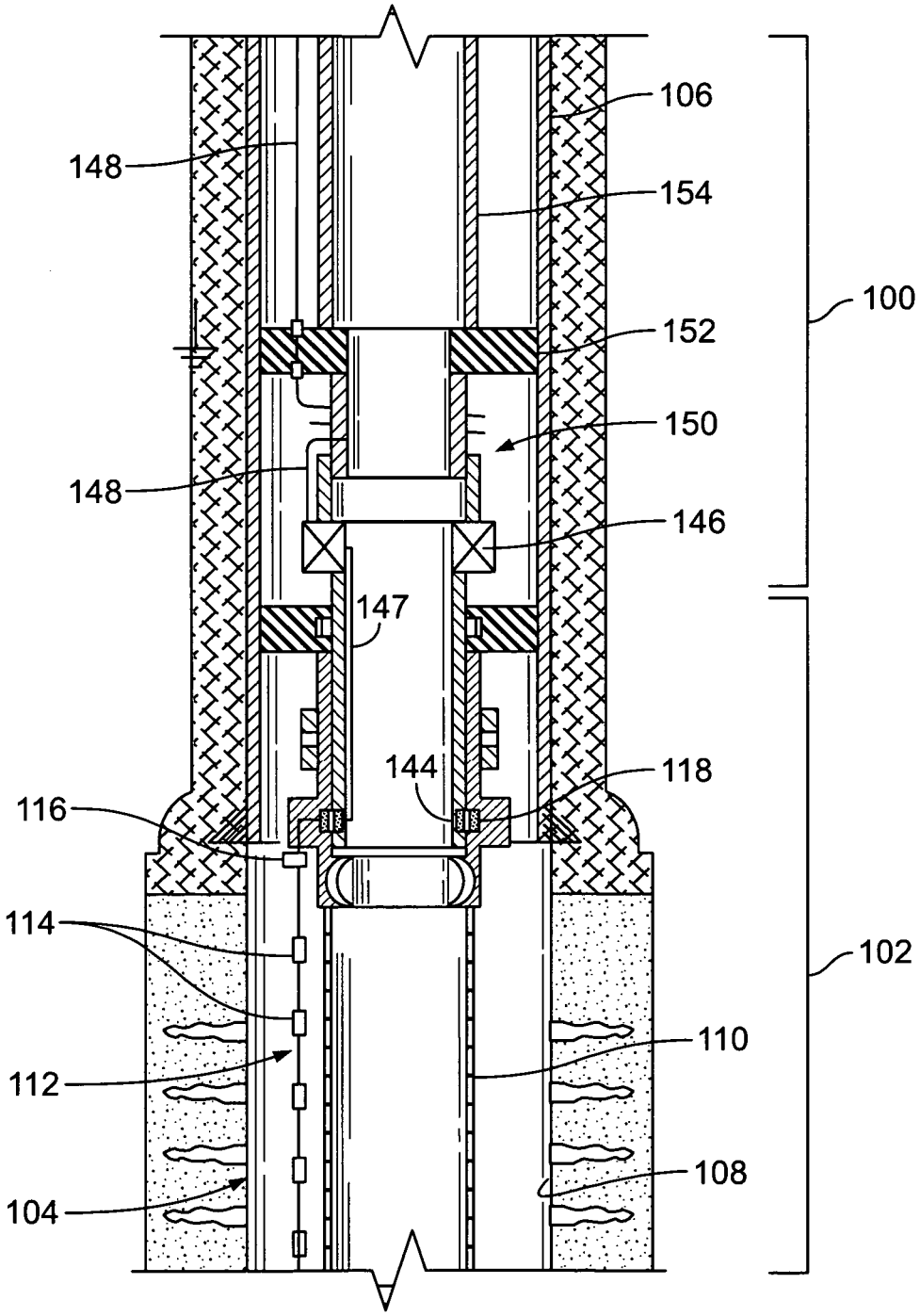
FIG. 1 illustrates an example downhole two-stage completion system having an example inductive coupler.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

In accordance with some examples described herein, a completion system is provided for installation in a well, where the completion system allows for real-time monitoring of downhole parameters, such as temperature, pressure, flow rate, fluid density, reservoir resistivity, oil/gas/water ratio, viscosity, carbon/oxygen ratio, acoustic parameters, chemical sensing (such as for scale, wax, asphaltenes, deposition, pH sensing, salinity sensing), and so forth. The well can be an offshore well or a land-based well. The completion system includes a sensor assembly (such as in the form of an array of sensors) that can be placed at multiple locations of a well. The "real-time monitoring" refers to the ability to observe the downhole parameters during some operation performed in the well, such as during production or injection of fluids or during an intervention operation. The sensors of the sensor assembly are placed at discrete locations corresponding to various points of interest. Also, the sensor assembly can be placed either outside or inside a sand control assembly, which can include a sand screen, a slotted or perforated liner, or a slotted or perforated pipe.

In some examples, a completion system having at least two stages (an upper completion section and a lower completion section) is used. In these examples, the lower completion section is run into the well in a first trip, where the lower completion section includes the sensor assembly. An upper completion section is then run in a second trip, where the upper completion section is inductively coupled to the first completion section to enable conveyance of signaling or communications and power between the sensor assembly and another component that is located uphole of the sensor assembly. The inductive coupling between the upper and lower completion sections enables both power and signaling to be established between the sensor assembly and uphole components, such as a component located elsewhere in the wellbore or at the earth surface.

The phrase "two-stage completion" should also be understood to include those completions where additional completion components are run in after the first upper completion, such as commonly used in some cased-hole frac-pack applications. In such wells, inductive coupling may be used between the lowest completion component and the completion component above, or may be used at other interfaces between completion components. A plurality of inductive couplers may also be used in the case that there are multiple interfaces between completion components.

AC induction relates to transference of a time-changing electromagnetic signal or power that does not rely upon a closed conductive electrical circuit but, instead, includes a magnetic component or circuit. For example, if a time-changing current is passed through a first coil, then a consequence of the current variation is the generation of an electromagnetic field in the medium surrounding the first coil. If a second coil is placed in that electromagnetic field, then a current is induced in the second coil. The efficiency of this inductive coupling increases as the coils are placed closer, but this is not a necessary constraint. For example, if a time-changing current is passed through a coil wrapped around a metallic mandrel, then a current will be induced in a coil wrapped around that same mandrel at some distance displaced from the first coil. In this way, a single transmitter can be used to power or communicate with multiple sensors along a wellbore. Given enough power, the transmission distance can be very large. For example, solenoid coils on the surface of the earth can be used to inductively communicate with subterranean coils deep within the wellbore. Also, the coils do not have to be wrapped as solenoids. Another example of inductive coupling occurs when a coil is wrapped as a toroid around a metal mandrel and a current is induced in a second toroid some distance removed from the first.

In alternative examples, the sensor assembly can be provided with the upper completion section rather than with the lower completion section. In yet other examples, a single-stage completion system can be used.

Though the upper completion sections are able to provide power to lower completion sections through inductive couplers, the lower completion sections also can obtain power from other sources such as, for example, batteries or power supplies that harvest power from vibrations (e.g., vibrations in the completion system). Power supplies that harvest power from vibrations can include a power generator that converts vibrations to power that is then stored in a charge storage device such as a battery. When the lower completion obtains power from other sources, the inductive coupling may still be used to facilitate communication across the completion components.

In some of the examples described herein, the completion architecture enables telemetry or communications in both directions (i.e., from the surface to a downhole location and from one or more of the downhole electrical devices to the surface) in a differential mode via a two-wire cable. In other words, a differential voltage and/or current between two wires of a cable may transmit telemetry frames. In addition, with these examples, the completion architecture enables power to be conveyed as a common mode signal on the same two wires of the cable. In some examples, at the surface, a modulation transformer enables multiplexing of the power signal and the telemetry or communications signal. In this example, the communications signal is a differential voltage signal between the two wires of the cable and the power signal is an alternating current (AC) signal that is transmitted on the two wires of the cable via a direct connection to a center tap or mid-point of a secondary coil of the modulation transformer. Therefore, the voltage between each of the wires of the cable and the mass (e.g., cable armor, completion, etc.) carries an AC voltage+/−half of the communications signal. The AC voltage of the power source in the examples described herein may range from about 150 Volts to about 600 Volts or may have a broader range from about 100 Volts to about 1000 Volts. The power and communications carrier frequencies are selected to optimize maximum transmission distance, baud rates, telemetry robustness and power efficiency for any particular application. Also, the power signal can be transmitted at low frequency via a coupler coil having a relatively large number of turns with high efficiency, and the communications signal can be transmitted with lower efficiency via a coupler coil having a relatively fewer number of turns.

In some of the examples described herein, power and telemetry or communications are transmitted through an inductive coupler without any solid state electronics or additional modulation transformers because the telemetry coils are used as a modulation transformer. In one example, both ends of the armored cable wires are directly coupled to a primary coil of the telemetry coupler while an additional wire couples the center tap of the primary coil to one end of a primary coil of a power coupler, the other end of the coil being connected to the mass. The differential voltage, which is the communications or telemetry signal, is magnetically conveyed to the telemetry secondary coil, while the AC power signal is magnetically conveyed to the power coupler secondary coil. Additionally, the power secondary coil is coupled to the center tap of the telemetry secondary coil and to the mass. Therefore, the two outputs of the telemetry secondary coil, which are directly connected to the two wires of the lower armored cable, carry the telemetry signal in differential mode and the power signal in the common mode, as is the case on the upper completion.

In accordance with the examples described herein, an inductive coupling for power and telemetry can be implemented without requiring the use of electronics between the surface unit and the downhole electrical devices (e.g., sensors, actuators, etc.). Further, the telemetry or communications and power may be bidirectional. In other words, communications may be sent from a surface unit to a downhole location and/or communications may be sent from a downhole location to the surface unit. Likewise, power may be conveyed downhole and/or may be sent uphole from a downhole location.

Still further, the examples described herein may be used to implement an electrical architecture for use with multi-stage and/or multi-lateral completions. In such examples, a primary coupler is installed in series on a cable and one or more secondary coupler(s) are connected in series and/or in parallel on the lower two wires. Electrical devices such as, for example, sensors, actuators or any other suitable electrical device may be connected in series and/or parallel on any of the two wires.

Also, in these examples, there may be multiple wires. For example, the ground or mass return may also be a wire or many wires in parallel, and the two wires carrying power and telemetry downhole may also be multiple wires in parallel.

An example inductive coupler assembly for use in a downhole environment described herein includes a first inductive coupler having first and second magnetically coupled coils and a second inductive coupler having third and fourth magnetically coupled coils. The first and third coils are coupled to a first pair of signal lines and the second and fourth coils are coupled to a second pair of signal lines. The first inductive coupler is to magnetically convey a differential telemetry or communications signal between the first and second pairs of signal lines and the second inductive coupler is to magnetically convey a common mode power signal between the first and second pairs of signal lines.

Another example inductive coupler assembly for use in a downhole environment includes a communications or telemetry coupler to convey a differential communications or telemetry signal between a first pair and a second pair of signal lines and a power coupler to convey a common-mode power signal between the first and second pairs of signal lines.

Still another example inductive coupler assembly for use in a downhole environment includes a first coil having a first connection to a first end of the first coil, a second connection to a second end of the first coil and a third connection to a center tap of the first coil. The example inductive coupler assembly also includes a second coil to be magnetically coupled to the first coil, the second coil having a fourth connection to a first end of the second coil, a fifth connection to a second end of the second coil and a sixth connection to a center tap of the second coil. In this example, there is also a third coil having a seventh connection to a first end of the third coil and an eighth connection to a second end of the third coil. The example inductive coupler assembly also includes a fourth coil to be magnetically coupled to the third coil, the fourth coil having a ninth connection to a first end of the fourth coil and a tenth connection to a second end of the fourth coil. In this example, the eighth and tenth connections are coupled to an electrical ground or return, the seventh connection is electrically connected to the third connection, and the ninth connection is electrically connected to the sixth connection so that the first and second coils magnetically convey communications and the third and fourth coils magnetically convey power.

An example method of conveying power and communications in a downhole environment includes transmitting a power signal and a communications signal via a first pair of wires, the power signal being a common-mode signal on the first pair of wires and the communications signal being a differential signal on the first pair of wires. The example method also includes magnetically conveying the communications signal from the first pair of wires to a second pair of wires via a first inductive coupler. Additionally, the example method includes magnetically conveying the power signal from the first pair of wires to the second pair of wires via a second inductive coupler.

Turning now to the figures, FIG. 1 shows a two-stage completion system with an upper completion section 100 engaged with a lower completion section 102. In this example, the two-stage completion system is a sand face completion system that is designed to be installed in a well that has a region 104 that is un-lined or un-cased (i.e., "open hole region"). As shown in FIG. 1, the open hole region 104 is below a lined or cased region that has a liner or a casing 106. In the open hole region 104, a portion of the lower completion section 102 is provided proximate to a sand face 108.

To prevent passage of particulate material, such as sand, a sand screen 110 is provided in the lower completion section 102. Alternatively, other types of sand control assemblies can be used, including slotted or perforated pipes or slotted or perforated liners. A sand control assembly is designed to filter particulates, such as sand, to prevent such particulates from flowing from a surrounding reservoir into a well.

In accordance with some examples, the lower completion section 102 has a sensor assembly 112 that has multiple sensors 114 positioned at various discrete locations across the sand face 108. In some examples, the sensor assembly 112 is in the form of a sensor cable. The sensor cable 112 may be a continuous control line having portions in which the sensors 114 are provided. The sensor cable 112 is continuous in the sense that the sensor cable 112 provides a continuous seal against fluids, such as wellbore fluids, along its length. In some examples, the continuous sensor cable 112 may have discrete housing sections that are sealably attached together. In other examples, the sensor cable 112 can be implemented with an integrated, continuous housing without breaks.

In the lower completion section 102, the sensor cable 112 is also connected to a controller cartridge 116 that can communicate with the sensors 114. The controller cartridge 116 can receive commands from another location such as at the earth surface or from another location in the well (e.g., from a control station 146 in the upper completion section 100). These commands can instruct the controller cartridge 116 to cause the sensors 114 to take measurements or send measured data. Also, the controller cartridge 116 can store and communicate measurement data from the sensors 114. Thus, at periodic intervals, or in response to commands, the controller cartridge 116 may communicate the measurement data to another component (e.g., a control station 146) that is located elsewhere in the wellbore or at the earth surface. Generally, the controller cartridge 116 includes a processor and storage. The communication between the sensors 114 and control cartridge 116 can be bidirectional or can use a master-slave arrangement.

The controller cartridge 116 is electrically connected to a first inductive coupler portion 118 (e.g., a female inductive coupler portion) that is part of the lower completion section 102. As discussed further below, the first inductive coupler portion 118 allows the lower completion section 102 to communicate with the upper completion section 100 such that commands can be issued to the controller cartridge 116 and the controller cartridge 116 can communicate measurement data to the upper completion section 100. In examples in which power is generated or stored locally in the lower completion section 102, the controller cartridge 116 can include a battery or power supply.

Proximate to the lower portion of the upper completion section 100 is a second inductive coupler portion 144 (e.g., a male inductive coupler portion). When positioned next to each other, the second inductive coupler portion 144 and first inductive coupler portion 118 form an inductive coupler that allows for inductively coupled communication of data and power between the upper and lower completion sections 100 and 102.

An electrical conductor 147 (or conductors) extends from the second inductive coupler portion 144 to the control station 146, which includes a processor and a power and telemetry module (to supply power and to communicate signaling with the controller cartridge 116 in the lower completion section 102 through the inductive coupler). Additionally and optionally, the control station 146 may include sensors, such as temperature and/or pressure sensors.

The control station 146 is connected to an electrical cable 148 (e.g., a twisted pair electric cable) that extends upwardly to a contraction joint 150 (or length compensation joint). At the contraction joint 150, the electrical cable 148 may be wound in a spiral fashion (to provide a helically wound cable) until the electrical cable 148 reaches an upper packer 152 in the upper completion section 100. The upper packer 152 is a ported packer to allow the electrical cable 148 to extend through the packer 152 to above the ported packer 152. The electrical cable 148 can extend from the upper packer 152 all the way to the earth surface (or to another location in the well).

In another example, the control station 146 may be omitted, and the electrical cable 148 may run from the second inductive coupler portion 144 (of the upper completion section 100) to a control station elsewhere in the well or at the earth surface.

The contraction joint 150 is optional and may be omitted in other examples. The upper completion section 100 also includes a tubing 154, which can extend all the way to the earth surface. The upper completion section 100 is carried into the well on the tubing 154.

When the upper end lower completion sections 100 and 102 are engaged, communication between the controller cartridge 116 and the control station 146 can be performed through the inductive coupler that includes the inductive coupler portions 118 and 144. The control station 146 can send commands to the controller cartridge 116 in the lower completion section 102, or the control station 146 can receive measurement data collected by the sensors 114 from the controller cartridge 116.

Figure 2:
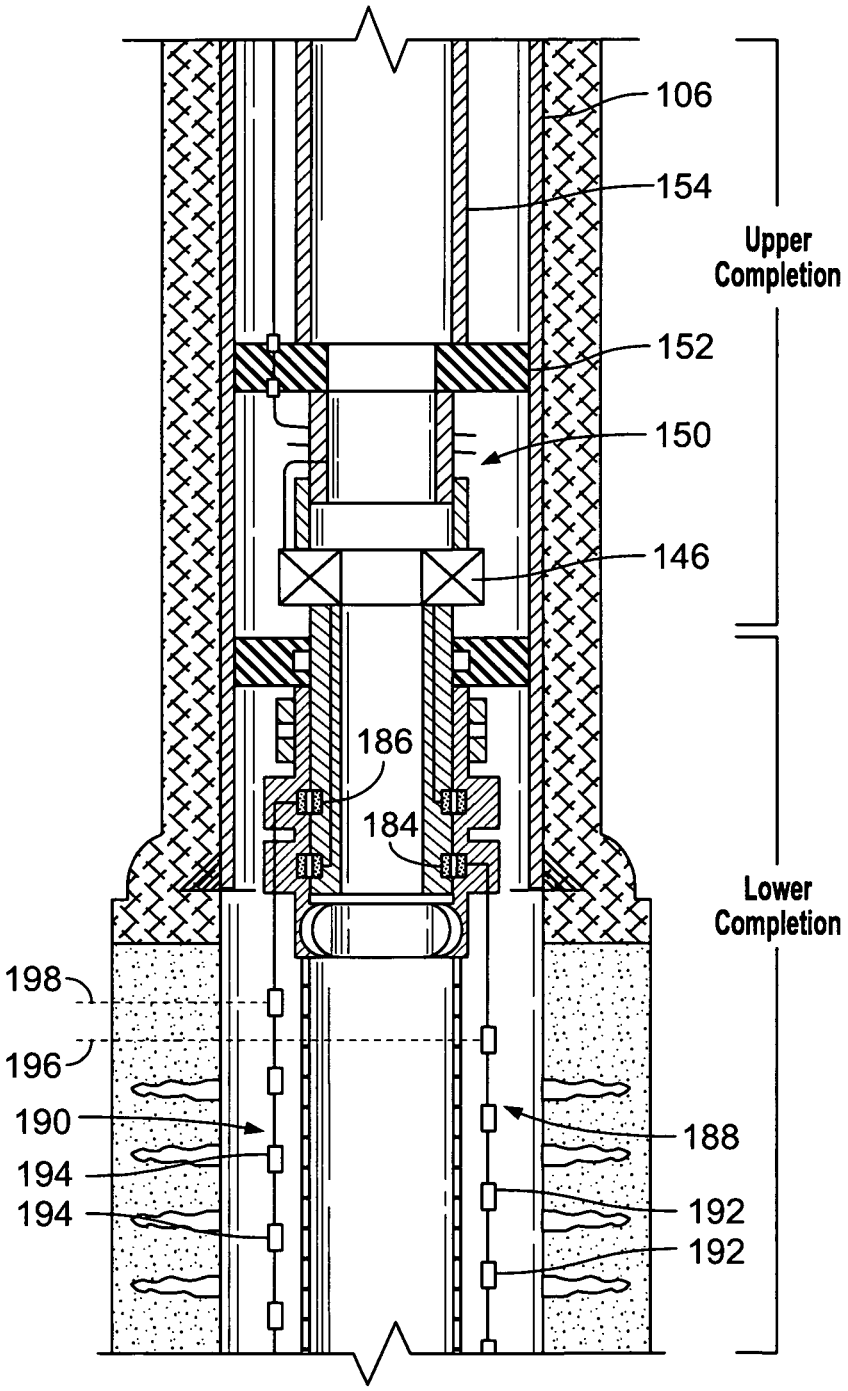
FIG. 2 illustrates another example two-stage completion system.

FIG. 2 shows another example that uses two inductive couplers 184 and 186, where the first inductive coupler 184 is used for power and data communication with a first sensor cable 188, and the second inductive coupler 186 is used to provide power and data communication with a second sensor cable 190. The use of two inductive couplers and two corresponding sensor cables in the FIG. 2 example provides for redundancy in case of failure of one of the sensor cables or one of the inductive couplers. The sensor cables 188 and 190 are generally parallel to each other. However, sensors 192 of the sensor cable 188 are offset along the longitudinal direction of the wellbore with respect to sensors 194 of the sensor cable 190. In other words, in the longitudinal direction, each sensor 192 is positioned between two successive sensors 194 (see dashed line 196 in FIG. 2). Similarly, each sensor 194 is positioned between two successive sensors 192 (see dashed line 198 in FIG. 2). By providing longitudinal offsets of sensors 192 and 194, the sensors 192 and 194 can collect measurements at different depths in the wellbore. In this manner, the effective density of sensors in the region of interest is increased if both sensor cables 188 and 190 are operational.

In another example, the sensor cables 188 and 190 can be run in series instead of in parallel as depicted in FIG. 2. In yet another arrangement, instead of both cables 188 and 190 being sensor cables, one of the cables can be a cable used to provide control, such as to control a flow control device (or alternatively, one of the cables can be a combination sensor and control cable).

In the examples discussed above, a sensor cable provides electrical wires that interconnect the multiple sensors in a collection or array of sensors. In an alternative example, wires between sensors may be omitted. In this case, multiple inductive coupler portions may be provided for corresponding sensors, with the upper completion section providing corresponding inductive coupler portions to interact with the inductive coupler portions associated with respective sensors to communicate power and data to the sensors.

Though reference has been made to communicating data between the sensors and another component in the well, in alternative examples in which sensors are provided with their own power sources downhole, the sensors may be provided with sufficient power to enable the sensors may make measurements and store data over a relatively long period of time (e.g., months). In those examples, an intervention tool can be lowered to communicate with the sensors to retrieve the collected measurement data. In one example, the communication between the intervention tool is accomplished using inductive coupling, where one inductive coupler portion is permanently installed in the completion, and the mating inductive coupler portion is on the intervention tool. The intervention tool may also be used to replenish (e.g., charge) the downhole power sources.

Figure 3:
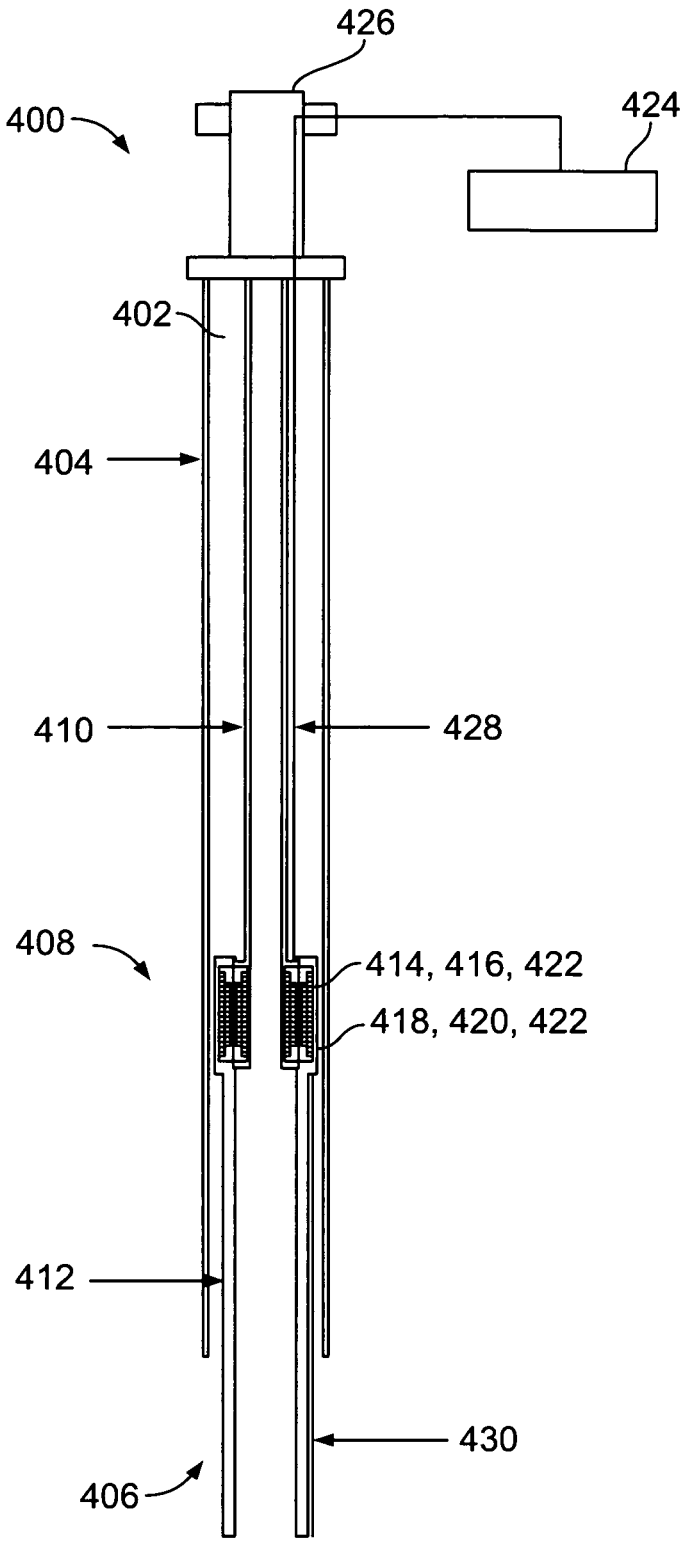
FIG. 3 illustrates an example single coil inductive coupler assembly.

FIG. 3 shows an example completion 400 disposed in a borehole 402 that includes, in this example, a cased section 404 and an uncased section 406. The example completion 400 includes an inductive coupler 408 having a single par of coils inductively coupling an upper completion 410 and a lower completion 412. Though a dual-stage completion is shown in FIG. 3, the example inductive coupler 408 and related electrical architecture (FIG. 4) may be applied for multi-stage and/or multi-lateral completions, as additional couplers may be configured in series or in parallel relative to a main bus.

The example inductive coupler 408 includes a male portion 414 having a first coil 416 and a female portion 418 having a second coil 420. The first coil 416 and the second coil 420 communicatively couple to form a single coil pair 422. In this example, power and communications are transmitted from a surface unit 424 through a wellhead 426 and down the upper completion 404 in a cable 428. The cable 428 in this example is an armored cable comprising one or a plurality of wires. Power and communications are magnetically conveyed or transferred via the single coil pair 422 to a cable 430 in the lower completion 412.

On the side of the upper completion 404, the cable 428 includes a permanent downhole cable ("PDC") wire, which is an encapsulated wire that couples power and telemetry for the downhole tools to the surface, that, in this example, is coupled directly to the upper coil 416. Thus, no additional electronics are needed. In other examples, the wire of the cable 428 may be coupled to electronics embedded inside the inductive coupler 408. In this example, no cartridge (such as, for example, the cartridge 116, described above) is needed. In yet another example, the wire in the cable 428 may be coupled to an electronics cartridge, which is coupled to the upper coil 416 through an armored cable. On the side of the lower completion 406, the cable 430 includes a PDC wire coupled directly to the lower coil 420, with no additional electronics. In other examples, the wire of the cable 420 is coupled to electronics embedded inside the coupler 408, without the need for a cartridge. Also, in another example, the wire of the cable is coupled to an electronics cartridge, which is coupled to the lower coil 420 via an armored cable.

Figure 4:
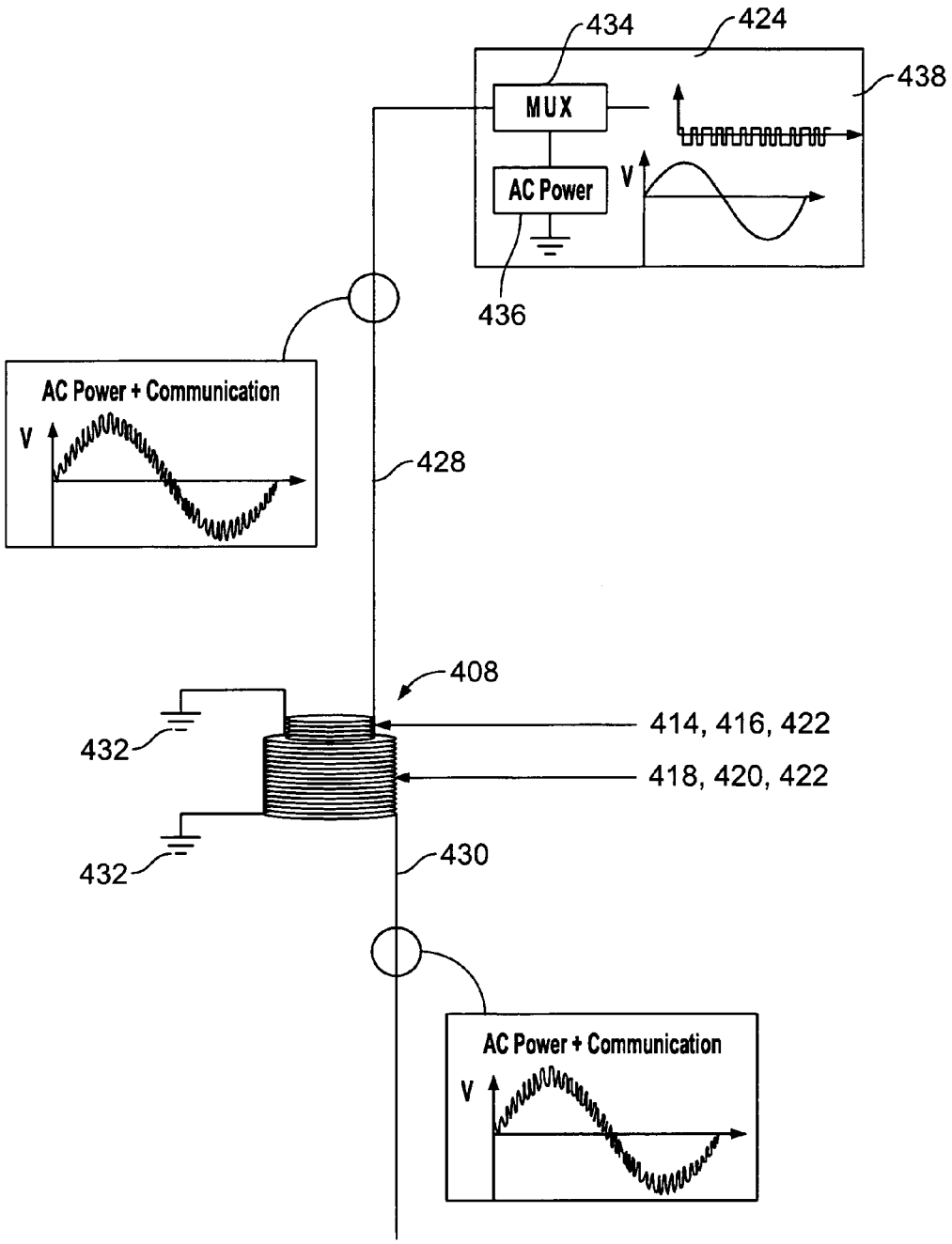
FIG. 4 illustrates example electrical architecture for the coupler assembly of FIG. 3.

An example electrical architecture for the example inductive coupler 408 of FIG. 3 is shown in FIG. 4. In the example shown, the PDC wire/cable 428 is coupled at one end to the upper coil 416. The other PDC wire/cable 430 is coupled to one end of the lower coil 420. The other end of the upper coil 416 and the other end of the lower coil 420 are coupled to a ground, a return path or a common mass (e.g., signal return, ground etc.) 432.

Also, in this example, the surface unit 424 includes a multiplexer 434 that multiplexes AC power 436 and communications 438 on the same wire 428. Both the power and the communications signals are transmitted as signals referenced to the armor, ground or electrical return. The frequency and/or amplitude may be adjusted to suit the needs of a particular application. The coupler 408 forms a transformer that enables both AC signals (power and communications) on the upper coil 416 to be recovered on the lower coil 420. The number of turns of electrically conductive material or wire used to implement the coils 416, 420 in the coupler 408 determine the bandwidth the coupler 408 can accommodate to effectively transmit a low frequency power signal and a higher frequency communications or telemetry signal.

In other examples, direct current (DC) power may be conveyed from the surface and a DC/AC converter is implemented prior to the upper coil 416 to transmit the power inductively. In this example, after the lower coil 420, the power may be implemented as an AC signal, or an AC/DC converter may be implemented to reconstruct the DC power signal.

Figure 5:
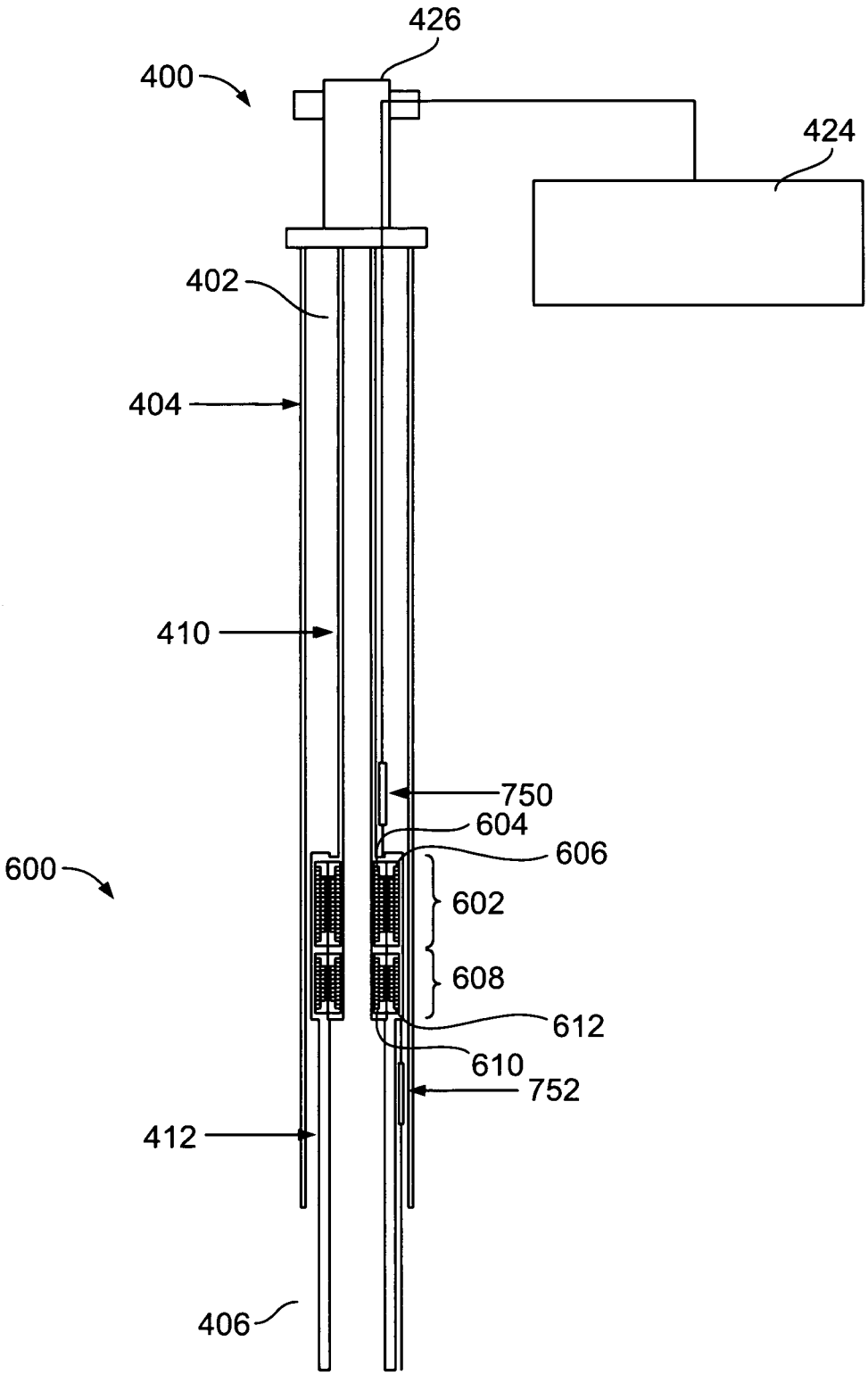
FIG. 5 illustrates an example double coil inductive coupler assembly.
Figure 6:
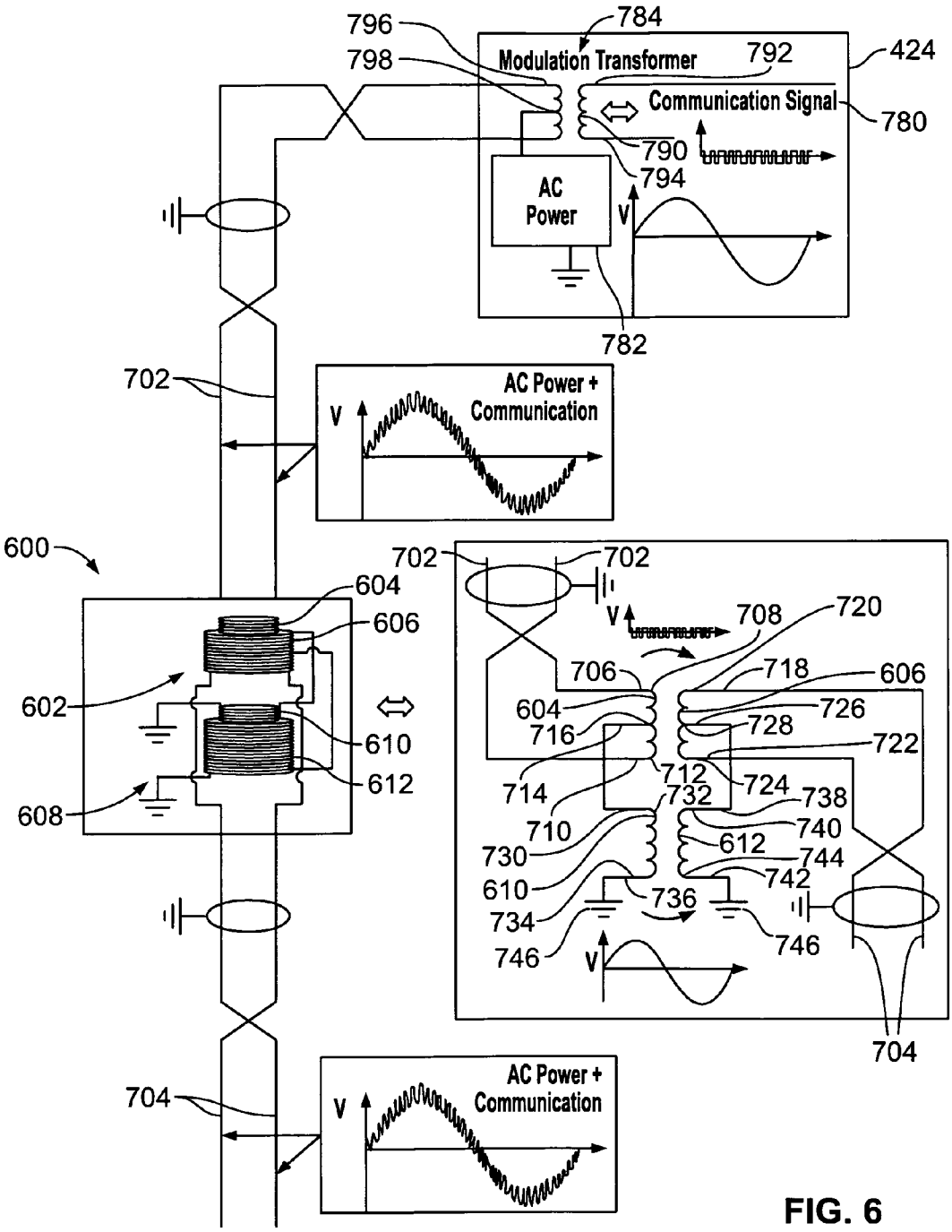
FIG. 6 illustrates example electrical architecture for the coupler assembly of FIG. 5.

FIG. 5 illustrates the completion 400 with the upper completion 410 and the lower completion 412 having another example inductive coupler assembly 600. FIG. 6 shows an example electrical architecture for the system of FIG. 5. The example inductive coupler assembly 600 includes a first inductive coupler 602 having a first coil 604 and a second coil 606. The first coil 604 and the second coil 606 are magnetically coupled. The example inductive coupler assembly 600 also includes a second inductive coupler 608 having a third coil 610 and a fourth coil 612. The third coil 610 and the fourth coil 612 are magnetically coupled. As shown in FIG. 6, the first 604 and third 610 coils are coupled to a first pair of signal lines 702 and the second 606 and fourth 612 coils are coupled to a second pair of signal lines 704. The first inductive coupler 602 magnetically conveys a differential communications signal between the first 702 and second 704 pairs of signal lines, and the second inductive coupler 608 magnetically conveys a common mode power signal between the first 702 and second 704 pairs of signal lines.

As shown in detail in FIG. 6, the first coil 604 of the example inductive coupler assembly has a first connection 706 to a first end 708 of the first coil 604, a second connection 710 to a second end 712 of the first coil 604 and a third connection 714 to a center tap 716 of the first coil 604. The second coil 606 is magnetically coupled to the first coil 604 and has a fourth connection 718 to a first end 720 of the second coil 606, a fifth connection 722 to a second end 724 of the second coil 606 and a sixth connection 726 to a center tap 728 of the second coil 606. The third coil 610 has a seventh connection 730 to a first end 732 of the third coil 610 and an eighth connection 734 to a second end 736 of the third coil. In addition, the fourth coil 612 is magnetically coupled to the third coil 610. Also, the fourth coil 612 has a ninth connection 738 to a first end 740 of the fourth coil 612 and a tenth connection 742 to a second end 744 of the fourth coil 612, wherein the eighth connection 734 and the tenth connection 742 are coupled to an electrical ground or return 746 (e.g., a common mass). The seventh connection 730 is electrically connected to the third connection 714, and the ninth connection 738 is electrically connected to the sixth connection 726 so that the first coil 604 and the second coil 606 magnetically convey communications and the third coil 610 and the fourth coil 612 magnetically convey power.

Thus, FIGS. 5 and 6 show the inductive coupler assembly 600 for use in a downhole environment that includes the first inductive coupler 602, which serves as a telemetry coupler to convey a differential telemetry signal between the first pair 702 and the second pair 704 of signal lines. The example inductive coupler assembly 600 also includes the second inductive coupler 608, which serves as a power coupler to convey a common-mode power signal between the first pair 702 and the second pair 704 of signal lines.

One or more of the first connection 706 at the first coil 604, the second connection 710 at the first coil 610, the fourth connection 718 at the second coil 606 and/or the fifth connection 722 at the second coil 606 is coupled to one or more sensors or actuators. For example, the sensors, actuators or other downhole tools may be coupled in parallel on two wires (see e.g., FIG. 8). Additionally, the tools may be coupled to the wires (e.g., wires 704), via an interposed modulation transformer. In addition, the wires 702, 704 may be coupled to the coils 604, 606, 610, 612 in any of the manners described herein such as, for example, directly to the coils without other electronics or cartridges, via electronics embedded in the inductive coupler assembly 600 and without a cartridge, or via an optional upper cartridge 750 and/or optional lower cartridge 752 (see discussion of cartridge 116, above).

In addition, the surface unit 424, as shown in FIG. 6, includes a telemetry or communications signal supply 780, a power supply 782, which is shown as an AC power supply. However, in other examples, the power supply 782 may be a DC power supply. The surface unit 424 also includes a modulation transformer 784. The communications signal supply 780 is coupled to a first coil 790 of the modulation transformer 784 at both a first end 792 and a second end 794 of the first coil 790. The power supply 782 is coupled to a second coil 796 of the modulation transformer 784 at a center tap 798. The modulation transformer 784 allows multiplexing or mixing of the power and telemetry signals.

Figure 7:
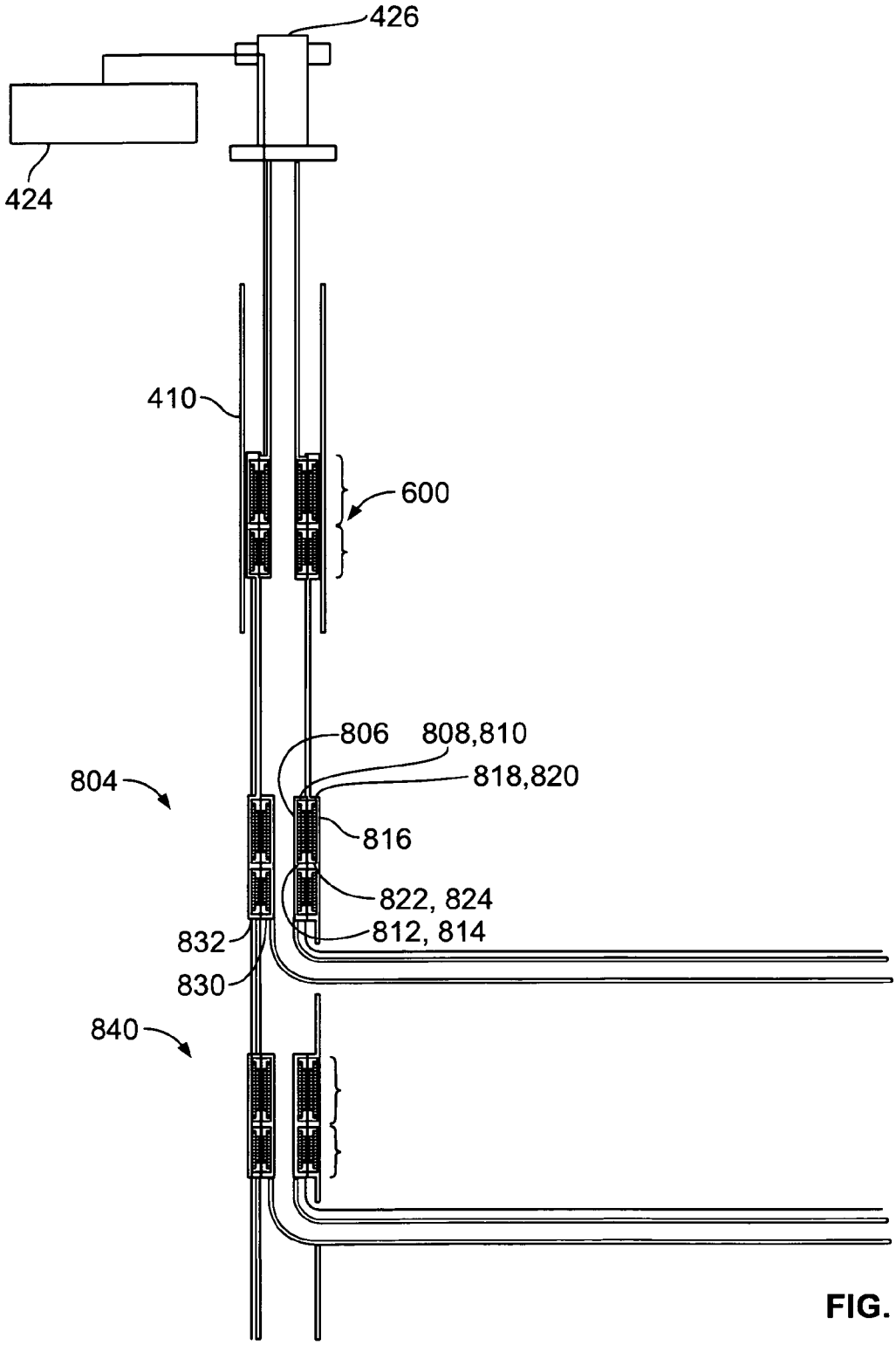
FIG. 7 illustrates an example multi-lateral inductive coupler assembly.
Figure 8:
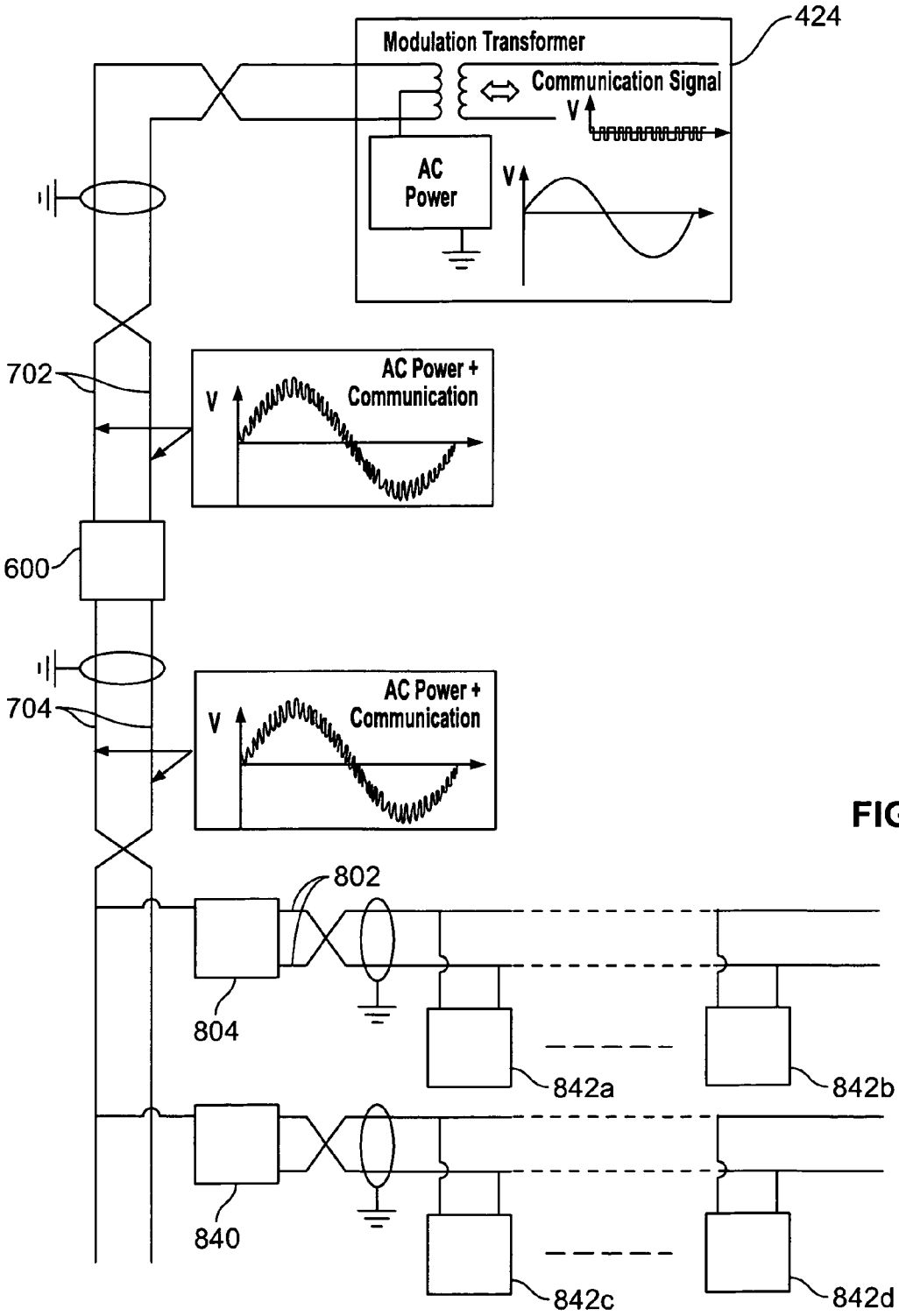
FIG. 8 illustrates example electrical architecture for the coupler assembly of FIG. 7.

As described above, in the inductive coupler assembly 600, the first pair 702 of signal lines is associated with the upper completion assembly 410 and the second pair 704 of signal lines is associated with the lower completion assembly 412, which is coupled to the upper completion assembly 410. In other examples, the pair of signal lines 704 may be associated with a lower completion assembly and another pair of signal lines 802 is associated with a lateral completion assembly, as shown in FIGS. 7 and 8. Specifically, another inductive coupler assembly 804 may be added, for example, below the first inductive coupler assembly 600 and coupled in any manner described herein. Thus, a third or extra-lower completion may be included, which achieves a triple-stage connection with connectivity on three stages.

In such a triple-stage example, there is a fifth coil 806 having an eleventh connection 808 to a first end 810 of the fifth coil 806 and a twelfth connection 812 to a second end 814 of the fifth coil 806. There is also a sixth coil 816 magnetically coupled to the fifth coil 806. The sixth coil 816 has a thirteenth connection 818 to a first end 820 of the sixth coil 816 and a fourteenth connection 822 to a second end 824 of the sixth coil 816. The fourth connection 718 and the thirteenth connection 818 are coupled, and the fifth connection 722 and fourteenth connection 822 are coupled. The fifth coil 806 and the sixth coil 816 magnetically convey the communications. There are also a seventh coil 830 and eighth coil 832 that are similarly coupled as described herein to magnetically convey power.

In another example, as shown in FIGS. 7 and 8, there may be a fourth inductive coupler pair 840 to form a multi-stage and/or a multi-lateral configuration. Further, there may be n-stages of completion with connectively to all stages using n−1 couplers connected in accordance with one or more of the electrical architectures described herein. For such multi-stage/multi-lateral completions, the electrical architecture, as shown in FIG. 8, combines completions in series and/or in parallel. The communications and power come from the surface unit 424, through the wellhead 426 and down the upper completion 410 in, for example, an armored cable including one or more wire(s).

Similar to the dual-stage completion, with the multi-lateral/multi-stage completion, the first coupler 600 is the primary coupler that links the upper and lower completions 410, 412. On the lower completion 412, any number of couplers 804, 840, etc. (i.e., secondary couplers) may be coupled to the lower completion armored cable, each secondary coupler 804, 840, etc. also comprising two pairs of coils. One or more electrical devices 842*a-d* and including, for example, sensors, actuators and/or any other electrical component(s) may be coupled to each subsequent and/or lateral extension.

Figure 9:
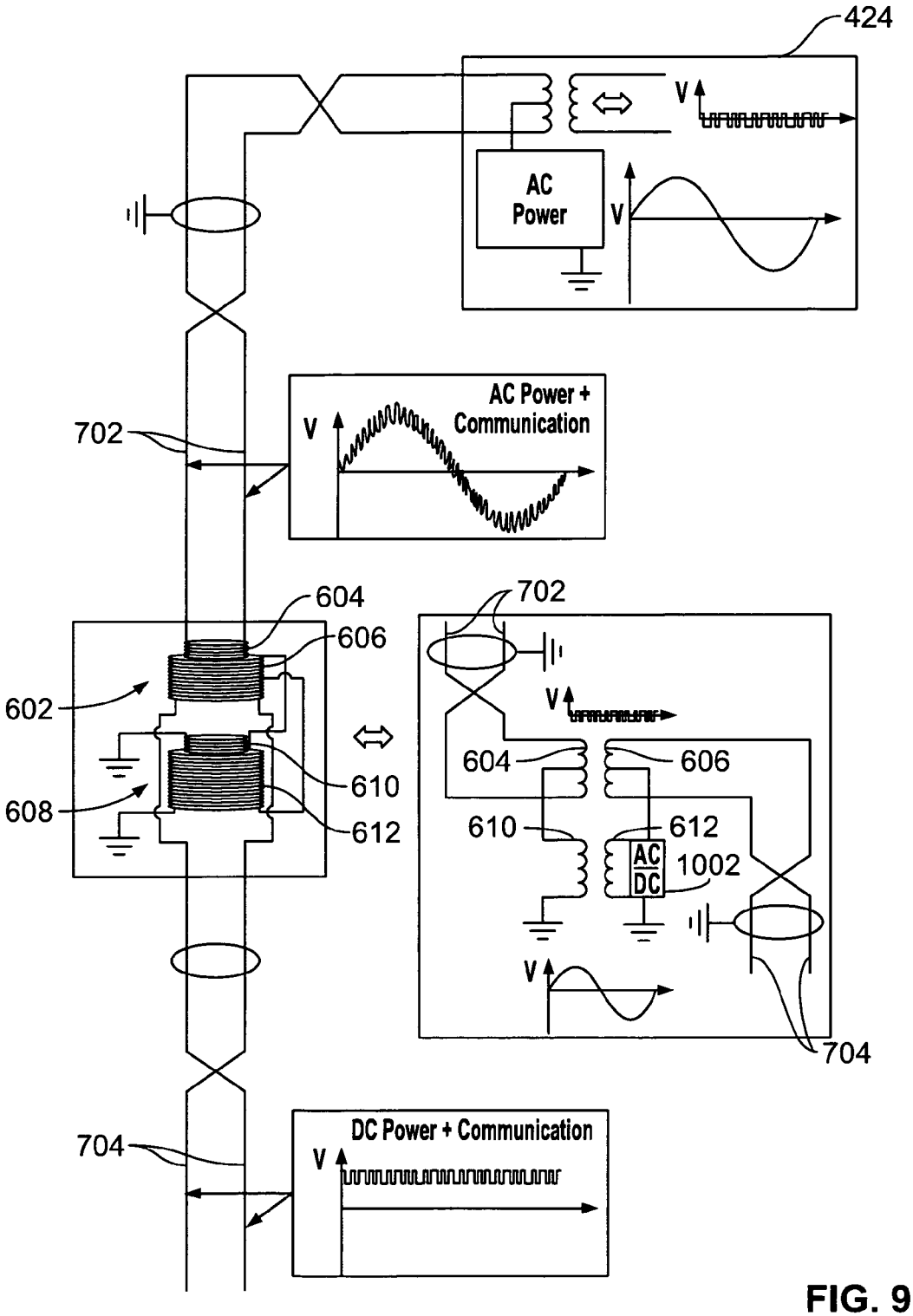
FIG. 9 illustrates another example electrical architecture for the coupler assembly of FIG. 5 including an example AC/DC converter.

FIG. 9 illustrates another example electrical architecture that includes an alternating current to direct current (AC/DC) converter or rectifier 1002 on the lower power coil output, i.e., the fourth coil 612. The AC/DC converter 1002 converts a common-mode power signal from an AC signal energizing the third coil 610 to a DC signal conveyed as a common mode DC signal via the fourth coil 612. Thus, the AC/DC converter 1002 converts the AC signal to a DC signal on the second pair of signal lines 704.

In one example, the AC/DC converter 1002 may be a diode coupled to one end of the power secondary coil 612, with the other end of the coil 612 grounded to the armor cable, tubing, casing, etc. In another example, the AC/DC converter 1002 may include a capacitor. In still another example, the AC/DC converter 1002 may be an AC power supply of any suitable topology and may include power factor correction circuits.

Figure 10:
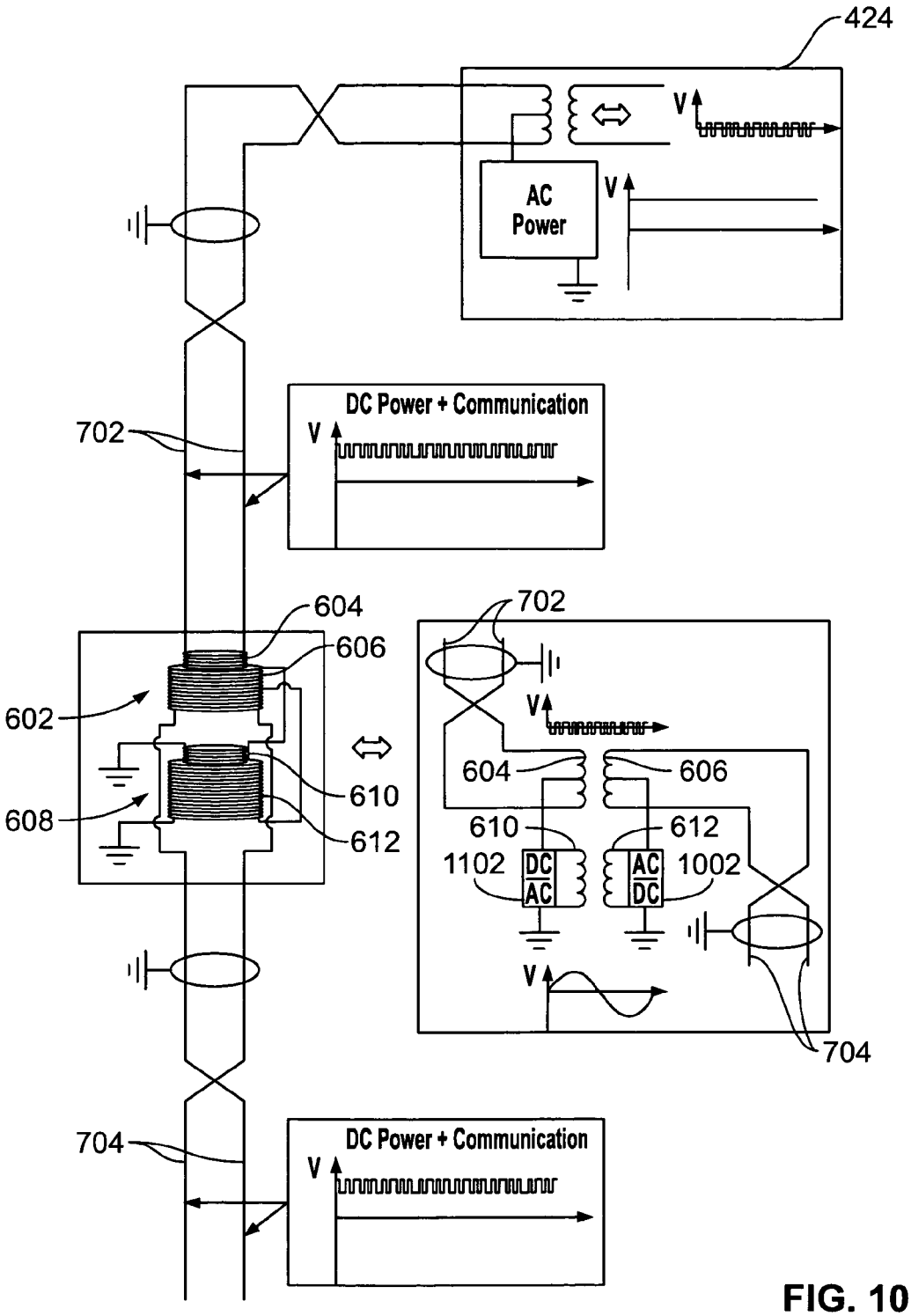
FIG. 10 illustrates another example electrical architecture for the coupler assembly of FIG. 5 including an example DC/AC converter and an example AC/DC converter.

FIG. 10 illustrates yet another example electrical architecture in which a direct current to alternating current (DC/AC) converter or rectifier 1102 is coupled to the third power coil 610 to convert a DC common mode power signal that is supplied from the surface via the first pair of signal lines 702 to the third coil 610 to an AC signal. The DC/AC converter 1102 effectively induces power through the coupler 608. The AC/DC converter 1002 on the lower side, i.e., the fourth coil 612, reconstructs the bus by enabling telemetry or communications to be conveyed in differential mode and power on a DC carrier via the common mode.

The examples of FIGS. 9 and 10 are also suitable for use in multi-stage systems by adding couplers in series or parallel as described above. If a coupler is placed in series, an additional DC/AC converter is used before a subsequent coupler to regenerate an AC power signal that can then be magnetically or inductively transmitted.

Figure 11:
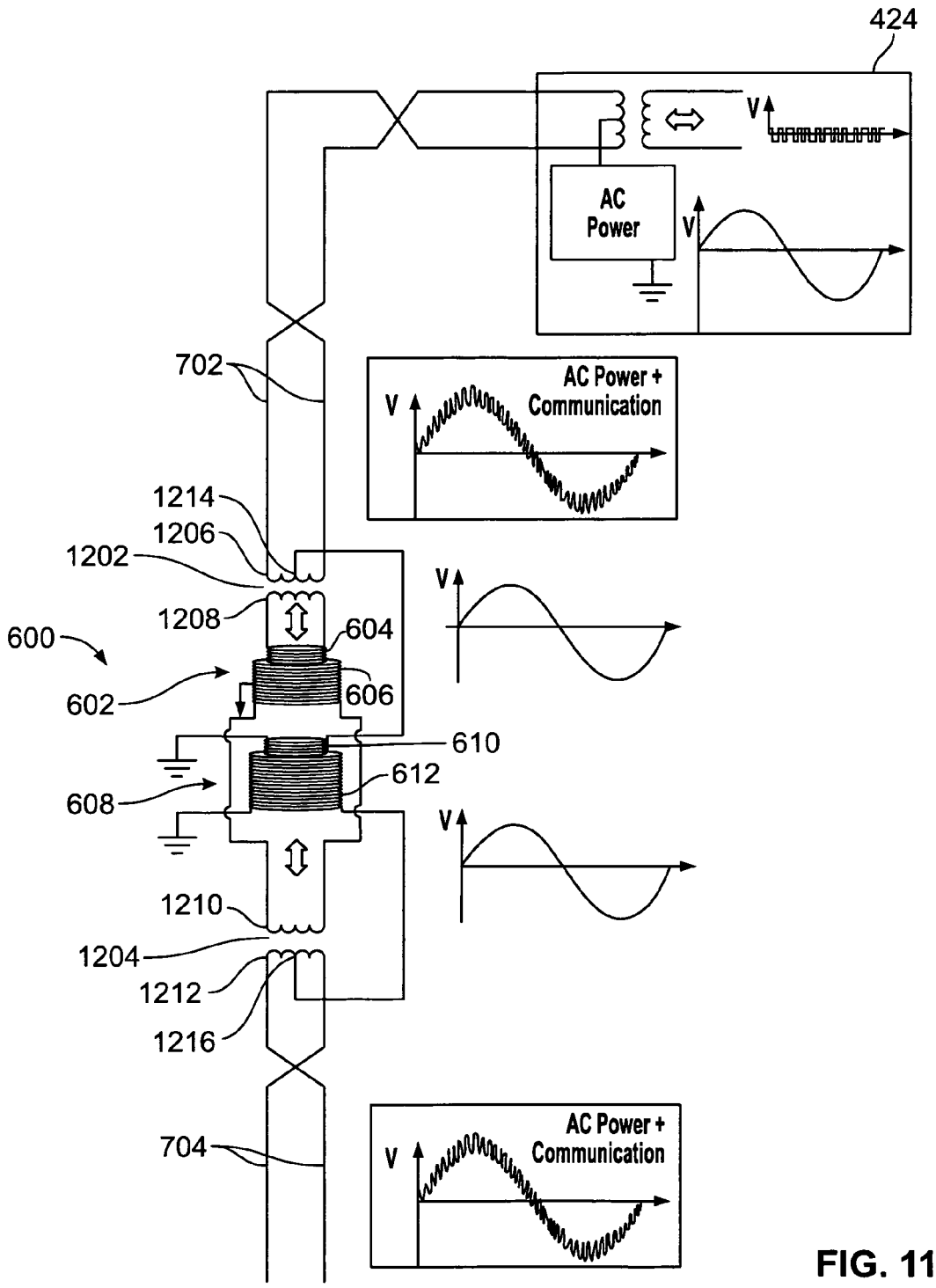
FIG. 11 illustrates another example electrical architecture for the coupler assembly of FIG. 5 including example modulation transformers.

An example electrical architecture including modulation transformers is shown in FIG. 11. In this example, a first modulation transformer 1202 is placed on one side of the inductive coupler assembly 600 before the first coil 604 and the second coil 606, and a second modulation transformer 1204 is placed on a second side of the inductive coupler assembly 600 after the third coil 610 and the fourth coil 612. The first modulation transformer 1202 includes a fifth coil 1206 that is inductively coupled to a sixth coil 1208, and the second modulation transformer 1204 includes a seventh coil 1210 that is inductively coupled to an eight coil 1212.

The first coil 604 is coupled to the first pair of signal lines 702 via the first modulation transformer 1202. The third coil 610 is electrically coupled to the first pair of signal lines 702 via a center tap 1214 of the first modulation transformer. In the example shown, the center tap 1214 is shown on the fifth coil 1206. In this example, the second coil 606 is coupled to the second pair of signal lines 704 via the second modulation transformer 1204. The fourth coil 612 is electrically coupled to the second pair of signal lines 704 via a center tap 1216 of the second modulation transformer 1204. In this example, the center tap 1216 is shown on the eighth coil 1212. Thus, in this example, the first and second modulation transformers 1202, 1204 are interposed between the telemetry coupler 602 and the first or second pair of signal lines 702, 704. The first and second modulations transformers 1202, 1204 may be embedded in the coupler assembly 600 or placed in one or more separate cartridges (e.g., similar to the cartridge 116).

On the upper side, the first modulation transformer 1202 allows demodulation, where the differential signal (communications or telemetry) is recovered on the secondary coil (coil 1208) of the first modulation transformer 1202, while the AC power is recovered from the mid-point (center tap 1214) of the primary coil (coil 1206). Both ends of the secondary coil (coil 1208) of the first modulation transformer 1202 are directly connected to both ends of the primary coil (coil 604) of the telemetry coupler 602, while the wire carrying the AC power is connected to one end of the power primary coil (coil 610), the other end of the coil 610 being connected to the mass (cable armor, chassis, tubing). The secondary coil (coil 606) of the telemetry coupler 602 recovers the telemetry signal, while the secondary coil (coil 612) of the power coupler 608 recovers the AC power.

On the lower side, the secondary coil (coil 606) of the telemetry coupler 602 is coupled at both ends to the primary coil (coil 1210) of the second modulation transformer 1204, while the secondary coil (coil 612) of the power coupler 608 is coupled to the mass and to the mid-point (center tap 1216) of the secondary coil (coil 1212) of the second modulation transformer 1204. The lower output of the second modulation transformer 1204 is coupled to the two wires 704 of the armored cable, with still the telemetry signal transmitted on the differential mode on the two wires 704 and the power transmitted on the common mode between the two wires 704 and ground.

In these examples, an inductive coupling is also achieved for power and telemetry between an upper a lower completion. The telemetry may be bidirectional where a telemetry modem may emit a telemetry signal to the surface. The power coupling can also be bidirectional in those situations where power generation does not occur at the surface. These examples are suitable for use with metal sleeves to protect the coils, multiple wires in the armored cable and for use in multi-stage/multi-lateral systems with additional couplers added in series and/or in parallel as described herein.

Figure 12:
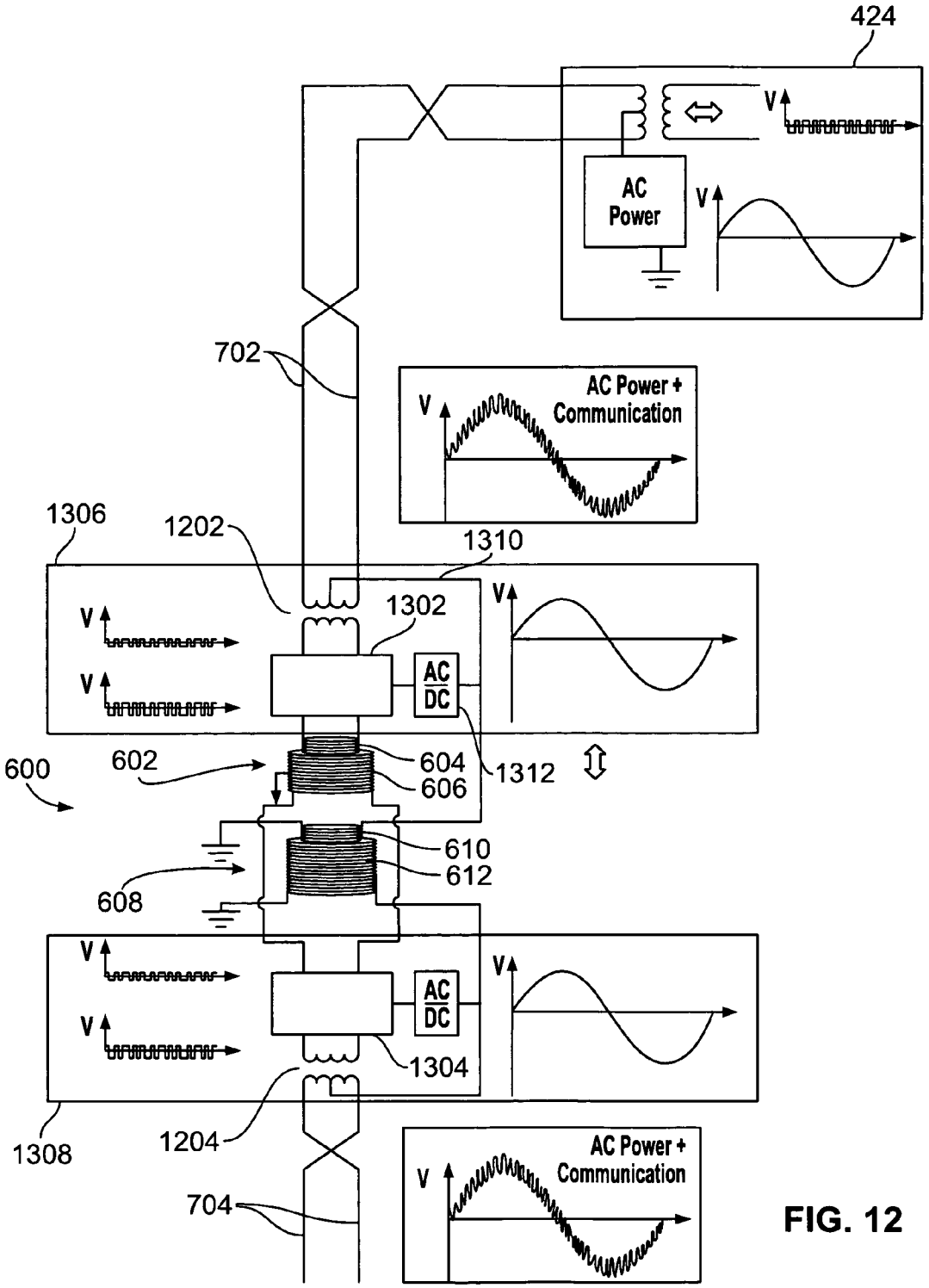
FIG. 12 illustrates another example electrical architecture for the coupler assembly of FIG. 5 including example telemetry conditioners.

FIG. 12 illustrates an example electrical architecture in which a first telemetry conditioner 1302 is interposed between the first modulation transformer 1202 and the telemetry coupler 602, and a second telemetry conditioner 1304 is interposed between the telemetry coupler 602 and the second modulation transformer 1204. Specifically, in the example shown, the first telemetry conditioner 1302 is interposed between the first modulation transformer 1202 and the first coil 604 of the telemetry coupler 602, and the second telemetry conditioner 1304 is interposed between the second coil 606 of the telemetry coupler 602 and the second modulation transformer 1204.

The first telemetry signal conditioner 1302 and the second telemetry signal conditioner 1304 are used to reconstruct and/or amplify the telemetry signal, which may become attenuated in the cable 702 and/or in the coupler assembly 600. The telemetry signal conditioners may be embedded in the coupler assembly 600 or placed in one or more separate cartridge(s) 1306, 1308.

As noted above, on the upper side, the first modulation transformer 1202 allows demodulation, where the differential signal (telemetry) is recovered on the secondary coil (coil 1208) of the first modulation transformer 1202, while the AC power is recovered from the mid-point (center tap 1214) of the primary coil (coil 1206). Electronics in the first telemetry conditioner 1302 re-condition the telemetry signal. The first telemetry conditioner 1302 is powered by an AC power bus 1310 and an AC/DC rectifier/power supply 1312.

The telemetry signal is then inductively transmitted through the telemetry coils, i.e., the telemetry coupler 602, and the power is inductively transmitted through the power coils, i.e., the power coupler 608. The telemetry signal may then be conditioned via the second telemetry conditioner 1304, which operates and is powered in the same manner described above. The second modulation transformer 1204 then enables the modulation of the power signal by the telemetry signal, as performed in the surface unit 424 as described above. In this example, the bus with the telemetry signal on the differential mode on two wires is induced, conditioned and propagated. and the power on an AC carrier transmitted via the common mode is also induced and propagated.

The first and second signal conditioners 1302, 1304 may be located on the upper side only, on the lower side only, or on both sides. In addition, the example system may be configured to construct a lower bus with the telemetry signal sent on the differential mode between the two wires and power on a DC carrier on the common mode. This would result in a combination of FIG. 9 and FIG. 12 topologies. In this example, an AC/DC converter is used on the lower side for power rectification, while the signal conditioner may use an AC/DC or DC/DC device on the lower side. Furthermore, the example system may be configured to have a upper and lower buses with the telemetry signal sent on the differential mode between the two wires and power on a DC carrier on the common mode. This would result in a combination of FIG. 10 and FIG. 12 topologies. In this example, a DC/AC converter is used on the upper side for the power bus, the signal conditioners may use an AC/DC or DC/DC device and an AC/DC converter is used, which is connected in series on the power line.

In these examples, the telemetry and/or power coupling may be bidirectional. Also, the architecture is suitable for use with metal sleeves, multiple wires and/or in multi-stage/multi-lateral systems as described herein.

Figure 13:
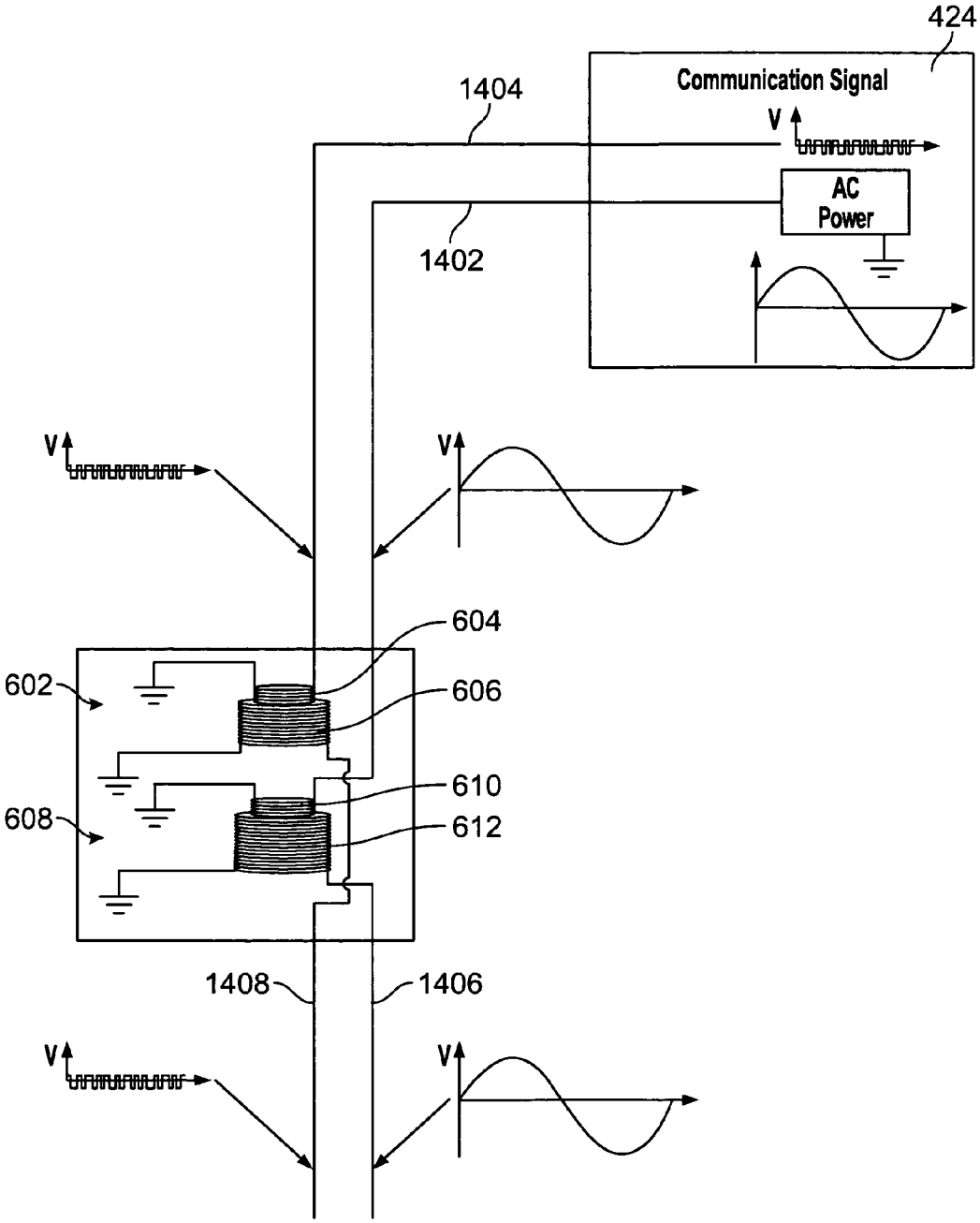
FIG. 13 illustrates alternative example electrical architecture.

FIG. 13 shows another example electrical architecture in which the power and telemetry are sent from the surface unit 424 placed before the wellhead 426. However, unlike the prior examples, the telemetry and power signals are not modulated or otherwise combined on the same lines but are transmitted on different lines. In this example, the power is conveyed as an AC signal on a dedicated line 1402 while the telemetry is conveyed on a separate line 1404, both sharing the same electrical return (e.g., the cable armor and completion tubing/casing/formation). The power line 1402 is directly coupled to the primary coil 610 of the power coupler 608, and the telemetry line 1404 is directly coupled to the primary coil 604 of the telemetry coupler 606. The other end of each coil is connected to the tubing and armor.

The power is recovered on the secondary coil 612 of the power coupler 608, which is directly coupled to the power line 1406 of the lower armored cables. The telemetry is recovered on the secondary coil 606 of the telemetry coupler 602, which is directly coupled to the telemetry line 1408 of the lower armored cables. Each of the secondary coils 606, 612 is coupled, at the other end, to the lower tubing and armor also to insure a correct grounding or electrical return. In this example, the upper bus 1402, 1404 is replicated in the lower bus 1406, 1408 without any use of electronics.

Figure 14:
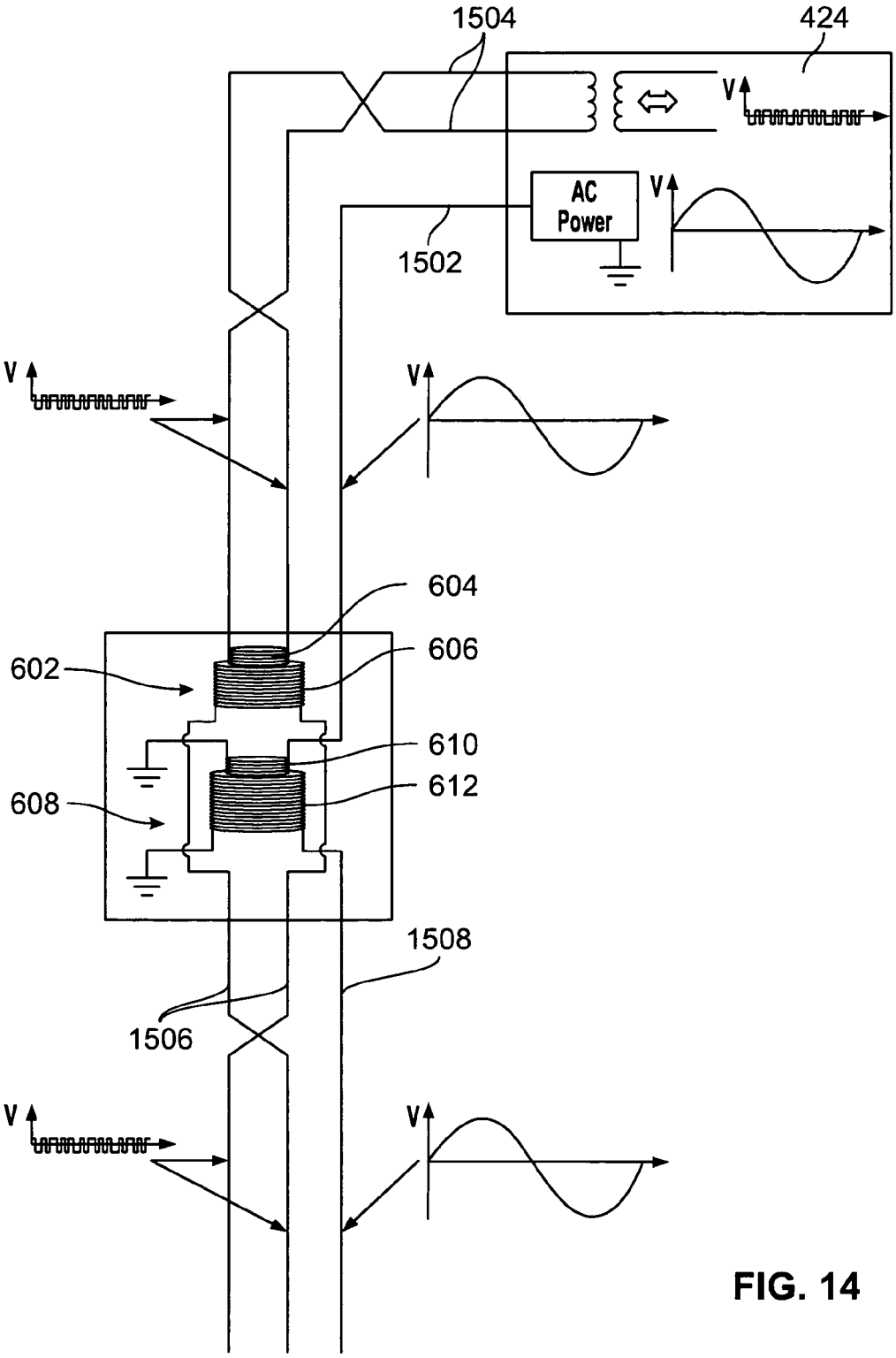
FIG. 14 illustrates further alternative example electrical architecture.
Figure 15:
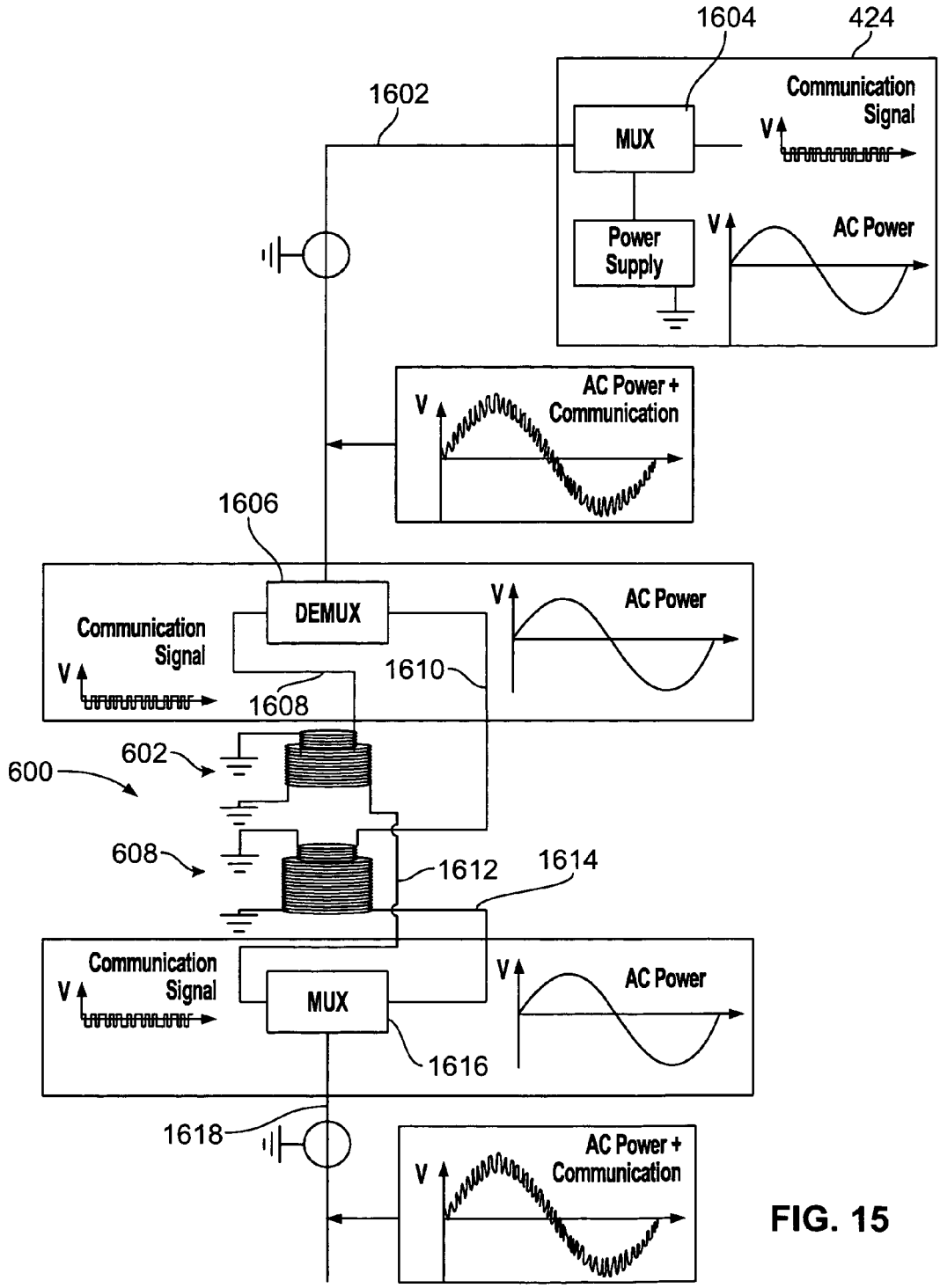
FIG. 15 illustrates another example electrical architecture for the coupler assembly of FIG. 5 including an example multiplexer and demultiplexer.

FIG. 14 shows another example electrical architecture. In the example of FIG. 15, the power is sent on a dedicated cable, i.e., a power line 1502. The telemetry is sent in differential mode on two dedicated lines, i.e., the telemetry lines 1504. In this example, one of the telemetry lines 1504 is coupled to an end of the primary coil 604 of the telemetry coupler 602 and the other of the telemetry lines 1504 is coupled to the other end of the primary coil 604. The telemetry is recovered on the secondary coil 606 of the telemetry coupler 602, each end of which is directly coupled to one of the telemetry lines 1506 of the lower armored cables. The power coupler 608 is coupled to the power line 1502 and the power line 1508 of the lower armored cable in the same manner as described with the example of FIG. 13.

Also, for both example architectures described and shown in FIGS. 13 and 14, similar architectures also may be configured to convey the power on a DC carrier from the surface. In such an example, on the upper side, a DC/AC converter is implemented prior to the power coupler 608 to transmit power inductively. On the lower side, either the power is conveyed via an AC signal on the lower power line or an AC/DC converter is implemented to reconstruct the DC bus. In addition, the possibility to convey power on an AC signal from the surface and reconstruct a DC bus on the lower side is also possible for both architectures.

As with the other examples, the examples of FIGS. 13 and 14 are also suitable for use with metal sleeves. Multiple wired cables for all architectures may be used including a plurality of wires to transmit the power. The power wires 1402, 1406, 1502, 1508 and the telemetry wires 1404, 1408, 1504, 1506 may be placed in different armored cables. Also, the architecture may be used with a dual-stage completion, multi-stage completion (as different couplers can be set in series) and/or multi-lateral completions (as the couplers may also be put in parallel on the main bus) or any combination thereof.

FIG. 15 shows another example electrical architecture. In the example of FIG. 15, the power and telemetry are transmitted from the surface unit on a single line 1602. In the surface unit 424, the power and telemetry signals are multiplexed on the single line 1602 with a first multiplexer 1604. Both signals are transmitted via the same propagation mode between the single wire 1602 and the armor. Before the inductive coupler assembly 600, the telemetry and power signal are de-multiplexed via a demultiplexer 1606 onto two wires, a first telemetry wire 1608 and a first power wire 1610 and transmitted separately through the telemetry coupler 602 and the power coupler 608, respectively.

On the output of the telemetry coupler 602, the telemetry signal is propagated on a second telemetry wire 1612, and on the output of the power coupler 608, the power signal is propagated on a second power wire 1614. Both the telemetry signal and the power signal are multiplexed once again via a second multiplexer 1616 to be transmitted via a single propagation mode, i.e., on a single wire 1618 operably associated with the armor/tubing/casing.

In another example, similar architecture may be used to transmit the power from the surface on a DC carrier. In this example, a DC/AC converter is implemented prior to the power coupler 608 to transmit power inductively. On the lower side, either the power is conveyed in AC on the lower power line or AC/DC is implemented to reconstruct the DC bus. In addition, the power may be conveyed on an AC carrier from surface and a DC bus may be reconstructed on the lower side, with both architectures.

As with the other examples described above, these architectures are also suitable with a metal sleeve multiple wired cables, and for dual-stage completions, multi-stage completions and/or multi-lateral completions.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An inductive coupler assembly for use in a downhole environment, comprising:

a first inductive coupler having first and second magnetically coupled coils; and a second inductive coupler having third and fourth magnetically coupled coils, wherein the first and third coils are coupled to a first pair of signal lines and the second and fourth coils are coupled to a second pair of signal lines, the first inductive coupler to magnetically convey a differential communications signal between the first and second pairs of signal lines and the second inductive coupler to magnetically convey a common mode power signal between the first and second pairs of signal lines.

2. The inductive coupler assembly as defined in claim 1, wherein each of the third and fourth coils has a respective first end coupled to an electrical ground or return path.

3. The inductive coupler assembly as defined in claim 2, wherein respective second ends of the third and fourth coils are electrically connected to respective ones of the first and second coils.

4. The inductive coupler assembly as defined in claim 3, wherein the respective second ends are electrically connected to respective center taps of the first and second coils.

5. The inductive coupler assembly as defined in claim 1, further comprising an alternating current to direct current converter coupled to the fourth coil to convert an alternating current signal energizing the third coil to a direct current signal conveyed as a common mode direct current signal via the fourth coil.

6. The inductive coupler assembly as defined in claim 5, wherein the common mode power signal is a direct current signal coupled to the third coil and further comprising a direct current to alternating current converter coupled to the third coil to generate the alternating current signal.

7. The inductive coupler assembly as defined in claim 1, wherein the first coil is coupled to the first pair of signal lines via a first modulation transformer and wherein the third coil is electrically connected to the first pair of signal lines via a center tap of the first modulation transformer.

8. The inductive coupler assembly as defined in claim 7, wherein the second coil is coupled to the second pair of signal lines via a second modulation transformer and wherein the fourth coil is electrically connected to the second pair of signal lines via a center tap of the second modulation transformer.

9. The inductive coupler assembly as defined in claim 8 further comprising a telemetry signal conditioner coupled between the first modulation transformer and the first coil or the second modulation transformer and the second coil.

10. The inductive coupler assembly as defined in claim 1, wherein the first pair of signal lines is associated with an upper completion assembly and the second pair of signal lines is associated with a lower completion assembly coupled to the upper completion assembly.

11. The inductive coupler assembly as defined in claim 1, wherein the first pair of signal lines is associated with a lower completion assembly and the second pair of signal lines is associated with a lateral completion assembly.

12. An inductive coupler assembly for use in a downhole environment, comprising:

a first coil having a first connection to a first end of the first coil, a second connection to a second end of the first coil and a third connection to a center tap of the first coil;

a second coil to be magnetically coupled to the first coil, the second coil having a fourth connection to a first end of the second coil, a fifth connection to a second end of the second coil and a sixth connection to a center tap of the second coil;

a third coil having a seventh connection to a first end of the third coil and an eighth connection to a second end of the third coil; and a fourth coil to be magnetically coupled to the third coil, the fourth coil having a ninth connection to a first end of the fourth coil and a tenth connection to a second end of the fourth coil, wherein the eighth and tenth connections are coupled to an electrical ground or return, the seventh connection is electrically connected to the third connection, and the ninth connection is electrically connected to the sixth connection so that the first and second coils magnetically convey communications and the third and fourth coils magnetically convey power.

13. An inductive coupler assembly as defined in claim 12, wherein one or more of the first connection, the second connection, the fourth connection or the fifth connection is coupled to one or more sensors or actuators.

14. An indicative coupler assembly as defined in claim 12 further comprising a fifth coil having an eleventh connection to a first end of the fifth coil and a twelfth connection to a second end of the fifth coil; and a sixth coil to be magnetically coupled to the fifth coil, the sixth coil having a thirteenth connection to a first end of the sixth coil and a fourteenth connection to a second end of the sixth coil, wherein the fourth and thirteenth connections are coupled, and the fifth and fourteenth connections are coupled, the fifth and sixth coils to magnetically convey the communications.

15. An inductive coupler assembly as defined in claim 12 further comprising at least one alternating current to direct current converter coupled to at least one of the third coil or the fourth coil.

16. An inductive coupler assembly as defined in claim 15, wherein each alternating current to direct current converter comprises at least one of a diode or a capacitor.

* * * * *